US005678628A

United States Patent [19]

Aki et al.

[11] Patent Number: 5,678,628

[45] Date of Patent: Oct. 21, 1997

[54] HEAT EXCHANGER AND METHOD FOR MANUFACTURING THE SAME

[75] Inventors: Yoshifumi Aki, Kariya; Mikio Fukuoka, Bisai, both of Japan

[73] Assignee: Nippondenso Co., Ltd., Kariya, Japan

[21] Appl. No.: 573,952

[22] Filed: Dec. 19, 1995

[30] Foreign Application Priority Data

Dec. 20, 1994 [JP] Japan ..... 6-316150
Oct. 20, 1995 [JP] Japan ..... 7-273011

[51] Int. Cl.[6] ..... F28F 9/02

[52] U.S. Cl. ..... 165/173; 165/149; 165/DIG. 489; 29/890.052

[58] Field of Search ..... 165/149, 153, 165/173, 76; 29/890.052

[56] References Cited

U.S. PATENT DOCUMENTS 3,113,615 12/1963 Huggins ..... 165/149
3,866,675 2/1975 Bardon et al. .
5,205,354 4/1993 Lesage .
5,251,694 10/1993 Chigira .
5,329,990 7/1994 Chigira .
5,366,007 11/1994 Hutto et al. .

FOREIGN PATENT DOCUMENTS 4319542 12/1994 Germany .
63-5288 1/1988 Japan .
4-43298 2/1992 Japan .
2098313 11/1982 United Kingdom .

*Primary Examiner*—Allen J. Flanigan
*Attorney, Agent, or Firm*—Cushman, Darby & Cushman IP Group of Pillsbury Madison & Sutro LLP

[57] ABSTRACT

A heat exchanger reduces a production of scrap portions and does not use a claw bending process at a time of forming a tank and a base plate. Each of the tank and the base plate is formed in a box shape having a U-shaped cross-section. The tank is joined to the base plate to close an end portion of an opening side of the tank using the base plate. A tube is inserted into a hole made at the base plate and fixed thereat in such a manner that the tube communicates with an inside of the tank. Each of the tank and the base plate is formed by folding an unfolded metal plate in which the box shape having the U-shaped cross section is in an unfolded state and joining a folded portion of the unfolded metal plate by brazing. According to the above configuration, the tank and the base plate can be structured by folding unfolded plates and by connecting the folded portions.

9 Claims, 14 Drawing Sheets

HEAT EXCHANGER AND METHOD FOR MANUFACTURING THE SAME

CROSS REFERENCE TO RELATED APPLICATIONS

This application is based on and claims priority of Japanese Patent Applications No. 6-316150 filed Dec. 20, 1994 and No. 7-273011 filed Oct. 20, 1995, the contents of which are incorporated herein by reference.

BACKGROUND OF THE INVENTION

1. Field of the Invention

The present invention relates to a heat exchanger which is preferably used for a heater core or the like for an automotive air conditioning device and a method for manufacturing the same, and more particularly to a method for forming and assembling a tank and a base plate of such a heat exchanger.

2. Description of Related Art

Conventionally, the kind of heat exchanger disclosed in Japanese Utility Model Laid-Open Publication No. 63-5288 has been proposed. Assembling structures of a tank 30 and a base plate 40 are shown in FIG. 17, and the tank 30 and the base plate 40 are made of metal such as aluminum or the like.

In FIG. 17, several claws 42 for fixing a tank temporarily are provided on an end portion 41 of the base plate 40. After the base plate 40 and the tank 30 are assembled together, the claws 42 are bent to be in contact with a stepped outer wall surface of the end portion 31 of the tank 30, and both the tank 30 and the base plate 40 are thereby fixed temporarily.

Then, the temporary assembled body such as the tank 30 or the like is heated up to a brazing temperature in a heating furnace, a brazing material 32 on a surface of the tank 30 is melted and the tank 30 and the base plate 40 are joined by brazing.

The tank 30 and the base plate 40 are generally made of a metal flat plate such as aluminum or the like by a drawing process. The drawing process can produce many parts within a short time period and has an advantage of high productivity. On the other hand, the drawing process provides a material having a larger shape than a finished shape of the parts, and excess portions (scrap portions) of the parts must be removed after the drawing process.

For instance, as shown in FIG. 18, a portion "$a_0$" of the tank 30 corresponds to the scrap portion, increasing the total cost for the material undesirably.

In a case of the base plate 40 as shown in FIG. 19, in order to provide the claws 42 at the edge portion 41, a portion "$b_0$", which is the part of a fringe around the base plate other than the claws 42, corresponds to the scrap portion, and such a portion "$b_0$", should be cut off. Therefore, total cost for the material is increased.

Further, an additional process is needed, and therefore, the number of working operations in the assembling process for crimping the claws 42 may be increased.

SUMMARY OF THE INVENTION

In view of the foregoing problems, it is a primary object of the present invention to provide a heat exchanger capable of preventing the scrap portions from being produced while a tank and a base plate are formed and a method for manufacturing the same.

Another object of the present invention is to provide a heat exchanger which can be assembled from a tank and a base plate without using a process for crimping claws and a method for manufacturing the same.

According to a first aspect of the present invention, a heat exchanger includes a tank formed in a box shape and including folded portions to form an opening and a base plate formed in a box shape and covering the opening of the tank. The base plate includes folded portions fixed to the folded portions of the tank and a bottom portion including a hole therein. The heat exchanger further includes a tube inserted into the hole of the base plate and fixed to the base plate to keep fluid communication with the tank.

According to the above configuration, the tank and the base plate can be structured by folding unfolded plates and by connecting the folded portions. Therefore, the scrap portion can be greatly reduced as compared to a heat exchanger produced by the conventional drawing process, and the cost for the material used can be thereby reduced.

According to a second aspect of the present invention, a method for manufacturing a heat exchanger includes steps of: cutting a metal plate to make an unfolded metal plate for forming a box-shaped tank; cutting a metal plate to make an unfolded metal plate for forming a base plate and making a hole into which a tube is inserted at the base plate; folding the metal plate for the tank along a predetermined folding line to form the tank in a box shape having an opening; folding the metal plate for the base plate along a predetermined folding line to form the base plate in a box shape having an opening; inserting an end portion of the tube into the hole of the base plate and assembling the tank with the base plate to cover the opening of the tank; and brazing the tank, the base plate and the tube integrally to make an assembled body.

According to this method, the above heat exchanger can be easily manufactured.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
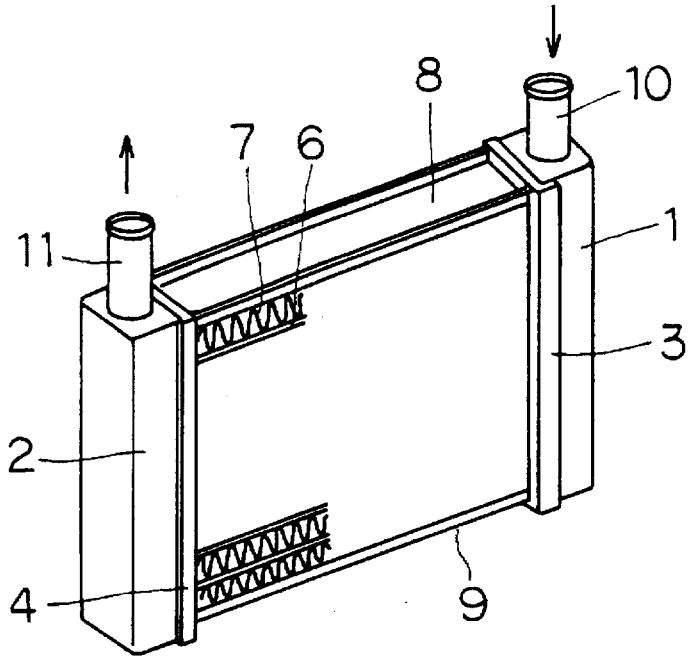
FIG. 1 is a perspective view illustrating a heat exchanger according to a first embodiment of the present invention.
Figure 2:
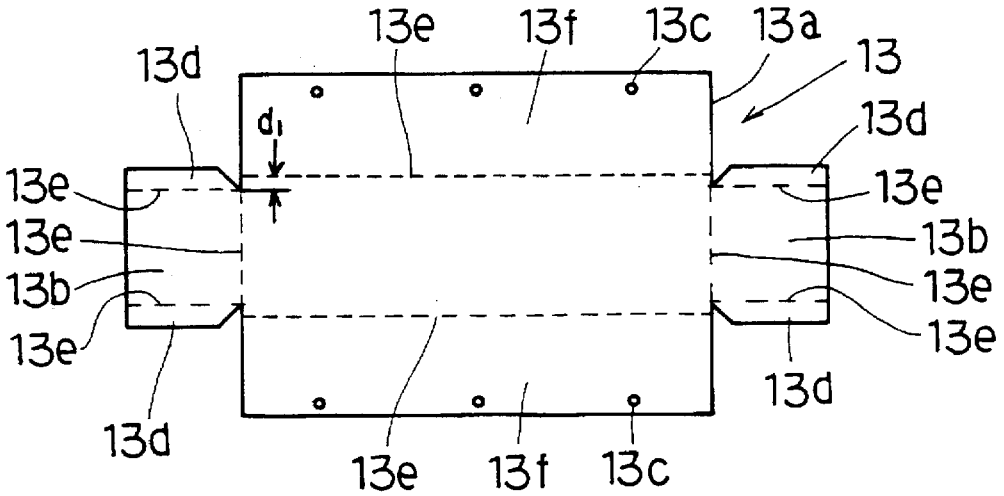
FIG. 2 is a plan view illustrating a metal plate forming the tank shown in FIG. 1.
Figure 3:
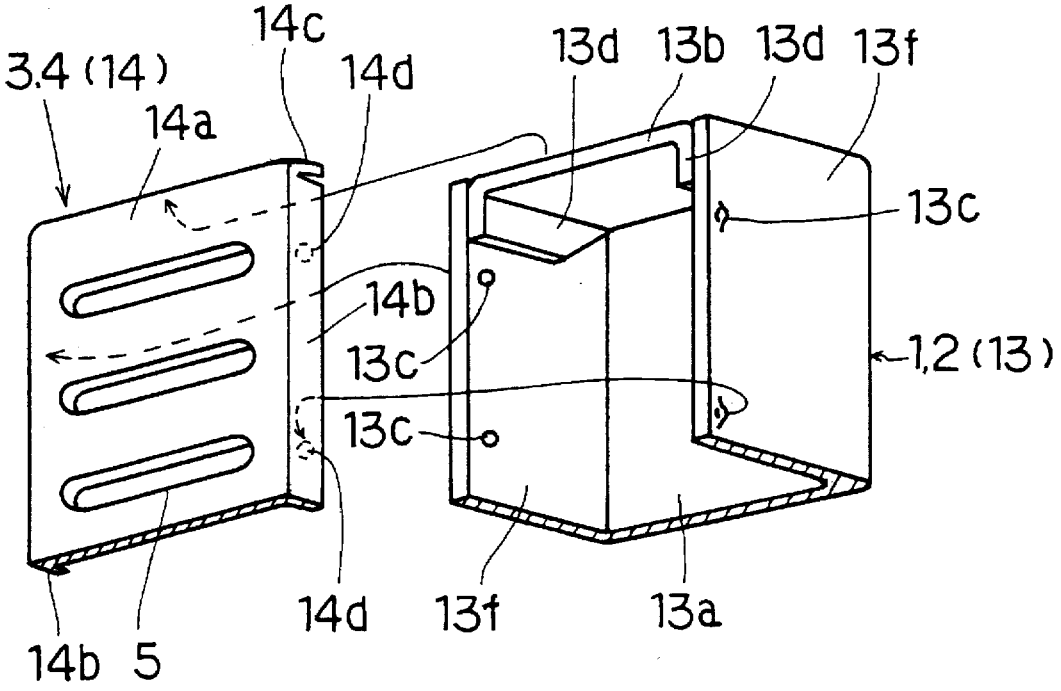
FIG. 3 is an exploded view illustrating an assembly of the tank and base plate in FIG. 1.

FIGS. 1 through 6 illustrate a first embodiment where the present invention is applied to a heater core (heat exchanger) of an automotive air conditioning apparatus. In FIG. 1, tanks 1 and 2 are formed into generally a U-shape in cross-sections thereof. Base plates 3 and 4, to which opening end portions of the tanks 1 and 2 are joined, are also formed into generally a U-shape in cross-sections thereof. In FIG. 3, on the base plates 3 and 4, a lot of flat-shaped holes 5 for receiving tubes are provided in such a manner that a longitudinal direction of the holes 5 for inserting the tubes is parallel to a short side direction of the base plates 3 and 4.

A cross-section of a flat tube 6 is formed into a flat shape, and each end portion of the flat tube 6 is inserted into and joined with the tube receiving holes 5 of the base plates 3 and 4. As illustrated in FIG. 1, corrugated fins 7 are formed into a wavy shape and disposed between the flat tubes 6 to be joined with the flat tubes 6.

End plates 8 and 9 are disposed at both side portions of a core portion (heat exchanging portion) having the flat tubes 6 and the corrugated fins 7 and are joined with the base plates 3 and 4 and the corrugated fin 7.

An inlet pipe 10 for warm water (engine cooling water) is inserted into and connected to a hole (not shown) provided at the tank 1. An outlet pipe 11 for cooled water (engine cooling water) is inserted and connected to a hole (not shown) provided at the tank 2. Since a structure of the heat exchanger in FIG. 1 is a symmetrical structure with respect to the left and right directions, the positions of inlet pipe 10 and the outlet pipe 11 may be interposed.

In this embodiment, the heater core shown in FIG. 1 is structured as an aluminum heat exchanger integrally joined by brazing. Although the corrugated fin 7 and the inlet pipe 10 are made of aluminum bare material (A 3000 series) with which a brazing material is not cladded, other members (1, 2, 3, 4, 6, 8, 9) are made of an aluminum cladded material in which a brazing material (A 4000 series) is cladded at both sides of the aluminum core material (A 3000 series).

FIG. 2 is a view illustrating an unfolded state of a metal plate forming the tanks 1 and 2. An unfolded metal plate 13 has a rectangular body portion 13*a*, and first folded portions 13*f* are formed at the body portion 13*a* along a long side portion thereof. Second folded portions 13*b* protruding with an ear-like shape from the short side portion of the body portion 13*a* are formed.

A plurality of semicircular protrusions 13*c* are formed at portions near each long end portion of the first folded portions 13*f* formed in a vertical direction of the body portion 13*a*.

Joint surfaces 13*d* for ensuring brazing by increasing a joint area to be brazed are formed at both outer edge portions in a vertical direction of the second folded portions 13*b* having the ear-like shape.

After a flat metal plate is cut into an unfolded shape shown in FIG. 2 by a pressing process, the unfolded metal plate 13 for the tank is formed into a tank shape shown in FIG. 3, i.e., a tank shape (box shape) having a U-shaped cross section, where one end side is open and another end side closed, by folding the first and the second folded portions 13*f* and 13*b* and the joint surface 13*d* at a ridgeline 13*e* shown with dotted lines in FIG. 2.

The joint surfaces 13*d* of the second folded portions 13*b* increase the brazing area by contacting the inner side surfaces of the first folded portions 13*f*. Thus, in order to make the joint surfaces 13*d* contact the inner side surfaces of the first folded portions 13*f*, the ridgeline 13*e* of the first folded portions 13*f* is offset outwardly from a position of the ridgeline 13*e* of the joint surfaces 13*d* by a plate thickness d1 of the unfolded metal plate 13.

Figure 4:
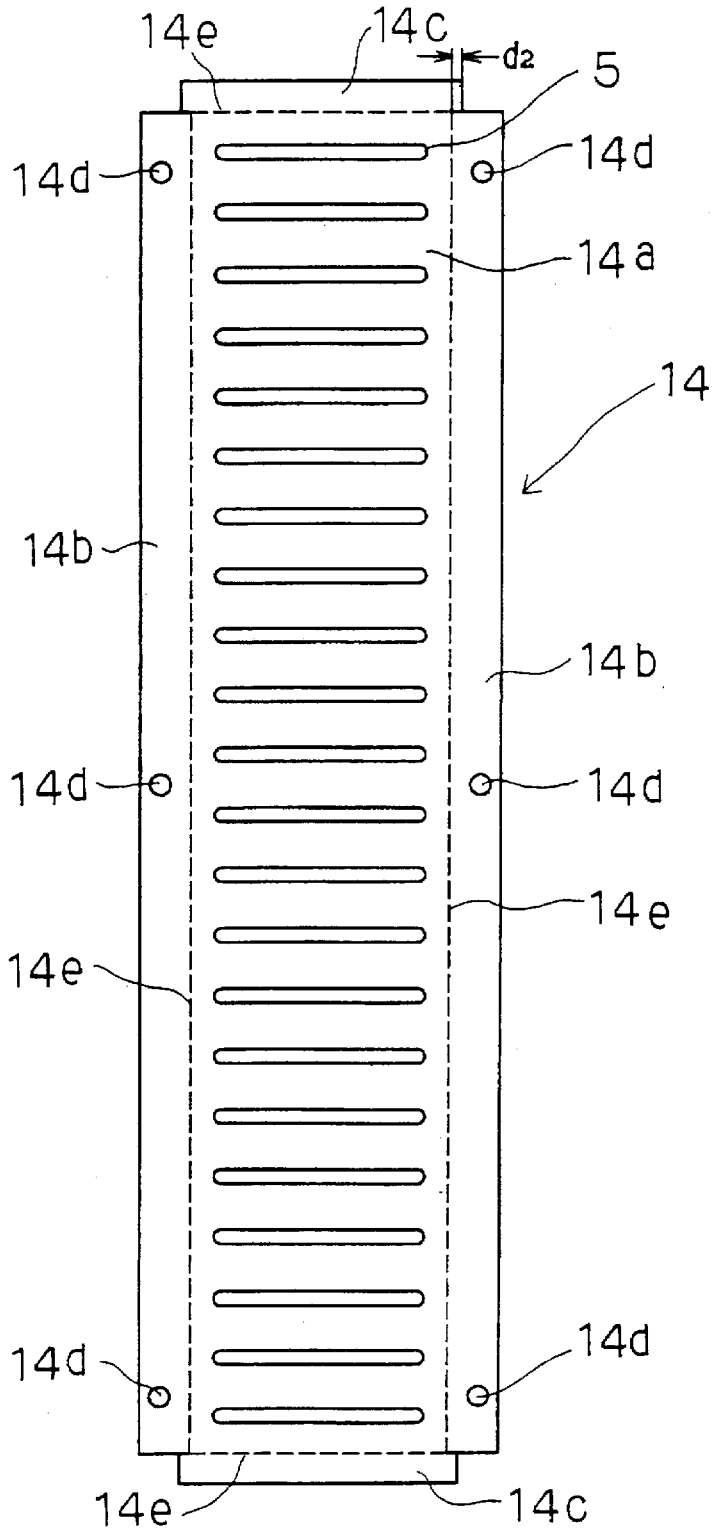
FIG. 4 is a plan view illustrating a metal plate forming the base plate in FIG. 1.

FIG. 4 is a view illustrating an unfolded state of the metal plate forming the base plates 3 and 4. An unfolded metal plate 14 for the base plates has the same shape as the unfolded metal plate 13 for the tank and has a rectangular body portion 14*a*, and first folded portions 14*b* are formed along a long side portion of the body portion 14*a*.

Second folded portions 14*c* are formed to protrude from short side portions of the body portion 14*a*.

A plurality of semicircular concave portions are formed at positions corresponding to the semicircular protrusions 13*c* at the first folded portions 14*b* of the body portions 14*a*. A dotted line 14*e* illustrates a ridgeline as a folding position of the first and the second folded portions 14*b* and 14*c*.

End portions in the longitudinal direction of the second folded portions 14*c* are offset outwardly from the dotted line 14*e* of the first folded portions 14*b* by a plate thickness d2 of the unfolded metal plate 14. Therefore, after folding the first and the second folded portions 14*b* and 14*c*, the second folded portions 14*c* can be folded on the end surface of the first folded portions 14*b* (see FIG. 3). Thus, the second folded portions 14*c* can be securely brazed on the end surface of the first folded portions 14*b*.

After cutting the metal plate into the unfolded shape shown in FIG. 4 by the pressing process, by folding the first and the second folded portions 14*b* and 14*c* at the dotted line 14*e*, the metal plate is formed into a shape shown in FIG. 3, i.e., a box shape in which one end side is closed and another end side is open. The second folded portions 14*c* are folded on the end surface of the first folded portions 14*b*, and a brazing area of the first and the second folded portions 14*b* and 14*c* is thereby obtained.

FIG. 3 is an exploded perspective view illustrating a structure of the tanks 1 and 2 formed by the unfolded metal plates 13 and 14 and the base plates 3 and 4. The tanks 1 and 2 and the base plates 3 and 4 are assembled in such a manner that the first and the second folded portions 13*f* and 13*b* of the tanks 1 and 2 are inserted into inner periphery sides of the first and the second folded portions 14*b* and 14*c* of the base plates 3 and 4.

At this time, an assembled state of the tanks 1 and 2 and the base plates 3 and 4 can be maintained by fitting the semicircular protrusions 13*c* of the tanks 1 and 2 into the semicircular concave portions 14*c* of the base plates 3 and 4, and therefore, the tanks 1 and 2 can be prevented from dropping off from the base plates 3 and 4 after being assembled together.

Figures 5A, 5B, 5C, 5D, 5E, 5F:
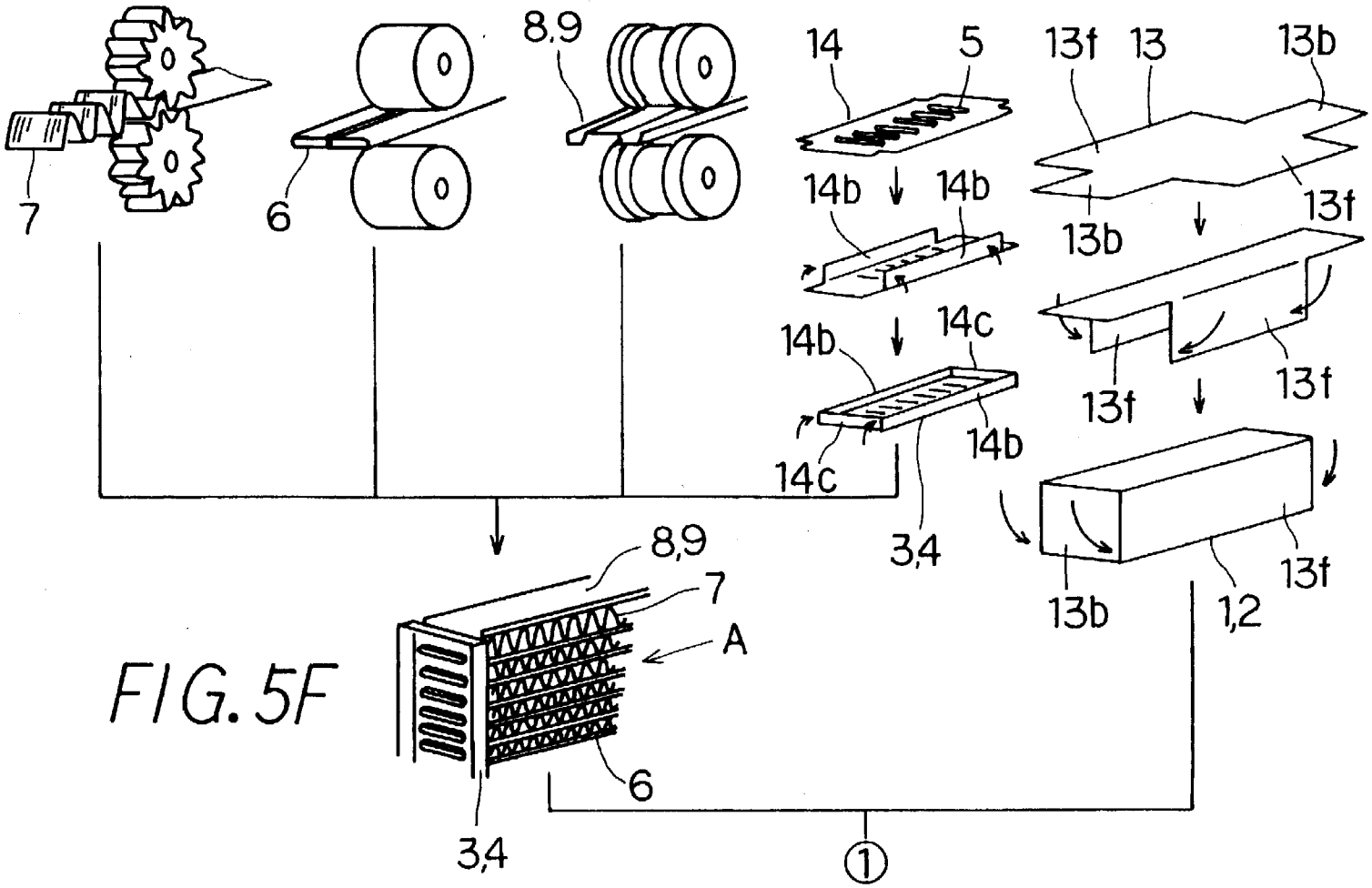
FIG. 5A is a schematic view illustrating a roller forming process of a corrugated fin of a first half of a manufacturing method according to a second embodiment of the present invention.
FIG. 5B is a schematic view illustrating a roller forming process of a flat tube of the first half of a manufacturing method according to the second embodiment of the present invention.
FIG. 5C is a schematic view illustrating a roller forming process of top and bottom end plates of the first half of a manufacturing method according to the second embodiment of the present invention.
FIG. 5D is a schematic view illustrating a process for forming base plates of the first half of a manufacturing method according to the second embodiment of the present invention.
FIG. 5E is a schematic view illustrating a process for forming tanks of the first half of a manufacturing method according to the second embodiment of the present invention.
FIG. 5F is a schematic view illustrating a process for forming a core portion of the first half of a manufacturing method according to the second embodiment of the present invention.

A method for manufacturing the heat exchanger of the present invention is described with reference to FIGS. 5A through 5F and 6A through 6C. FIGS. 5A through 5F illustrate a process for manufacturing an individual part of the heat exchanging component parts and an assembly of the core portion. FIG. 5A illustrates a roller forming process of the corrugated fin 7. FIG. 5B illustrates a roller forming process of the flat tube 6. FIG. 5C illustrates a roller forming process of the upper and lower end plates 8 and 9. FIG. 5D illustrates a process for forming the base plates 3 and 4 from the unfolded metal plate 14 by a folding process. FIG. 5E illustrates a process for forming the tanks 1 and 2 from the unfolded metal plate 13 by the folding process.

FIG. 5F illustrates a process for assembling a core portion A by assembling parts other than the tanks 1 and 2 such as the base plates 3 and 4, the flat tube 6, the corrugated fin 7 and the end plates 8 and 9. Specifically, the flat tubes 6 and the corrugated fins 7 are alternately laminated together. After the end plates 8 and 9 are assembled on each of the upper and lower end portions of the laminated body, the base plates 3 and 4 are assembled on the assembled body.

Figure 6A:
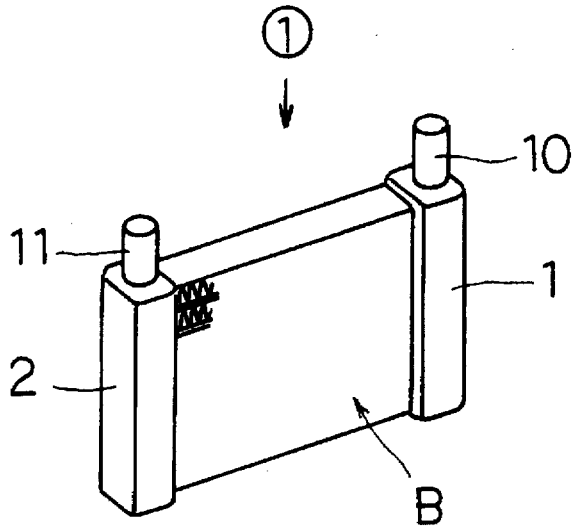
FIG. 6A is a schematic view illustrating a part assembling process in a last half of the manufacturing method according to the second embodiment of the present invention.
Figure 6B:
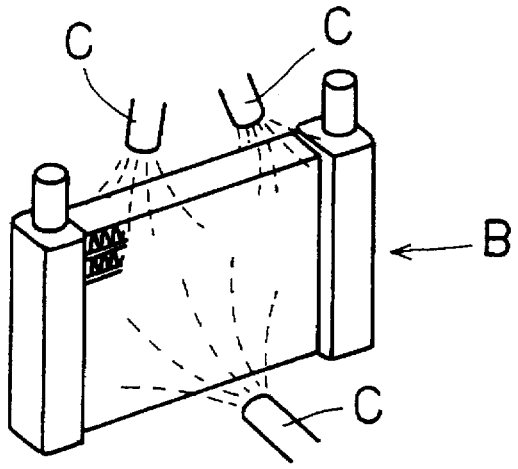
FIG. 6B is a schematic view illustrating a process for applying flux in the last half of the manufacturing method according to the second embodiment of the present invention.
Figure 6C:
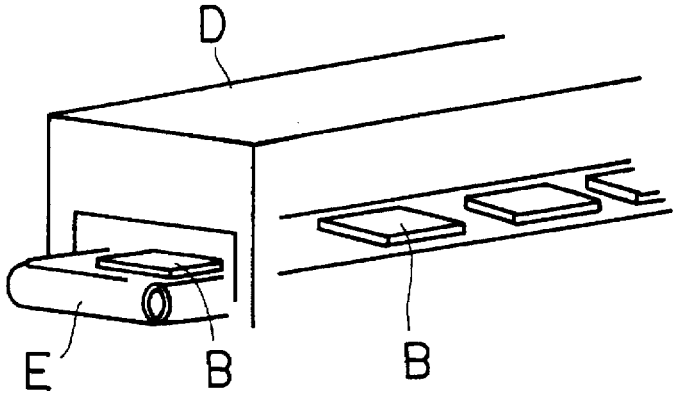
FIG. 6C is a schematic view illustrating a process for brazing in the last half of the manufacturing method according to the second embodiment of the present invention.

FIGS. 6A through 6C illustrate processes occurring after the process illustrated in FIG. 5F. FIG. 6A illustrates a parts assembling process in which an assembly of an overall heat exchanger is completed by assembling the tanks 1 and 2 and the inlet and the outlet pipes 10 and 11 to the core portion A in FIG. 5F.

FIG. 6B illustrates a process for injecting the flux from a nozzle C to the assembled body B which has been completed to improve brazing performance. The flux removes an oxide film interrupting the brazing of aluminum from each part surface of the assembled body B and prevents the surfaces from re-oxidizing in the heating furnace for brazing.

FIG. 6C is a process for integrally brazing the assembled body B by carrying the assembled body B of the heat exchanger into a heating furnace D by a conveyor E and by heating up the assembled body B to a specified temperature over a melting point of the brazing material in the heating furnace D. The heat exchanging structure shown in FIG. 1 is completed by the unit brazing.

In this case, even though each of the tanks 1 and 2 has a folded structure formed from the unfolded shape, the folded portion can be joined securely by brazing with joint surfaces 13*d* provided at the tanks 1 and 2.

At the base plates 3 and 4, by setting an offset length of the plate thickness d2, the second folded portions 14*c* are folded on the end surfaces of the first folded portions 14*b*. Thus, the first and the second folded portions 14*b* and 14*c* can be securely joined by brazing the contacting portions of the first and the second folded portions 14*b* and 14*c*.

Another embodiment of the present invention will be described below. In the first embodiment shown in FIG. 1, a heat exchanger is structured as a one-way flowing type (full pass) in which warm water flowing from the inlet pipe 10 provided on the tank 1 flows in the outlet pipe 11 provided on the tank 2 through the flat tube 6 and flows out from the outlet pipe 11. In another embodiment shown in FIGS. 7 through 11, the present invention is applied to a heat exchanger in which a flow of such the warm water makes a U-turn in the heat exchanging portion.

Figure 7:
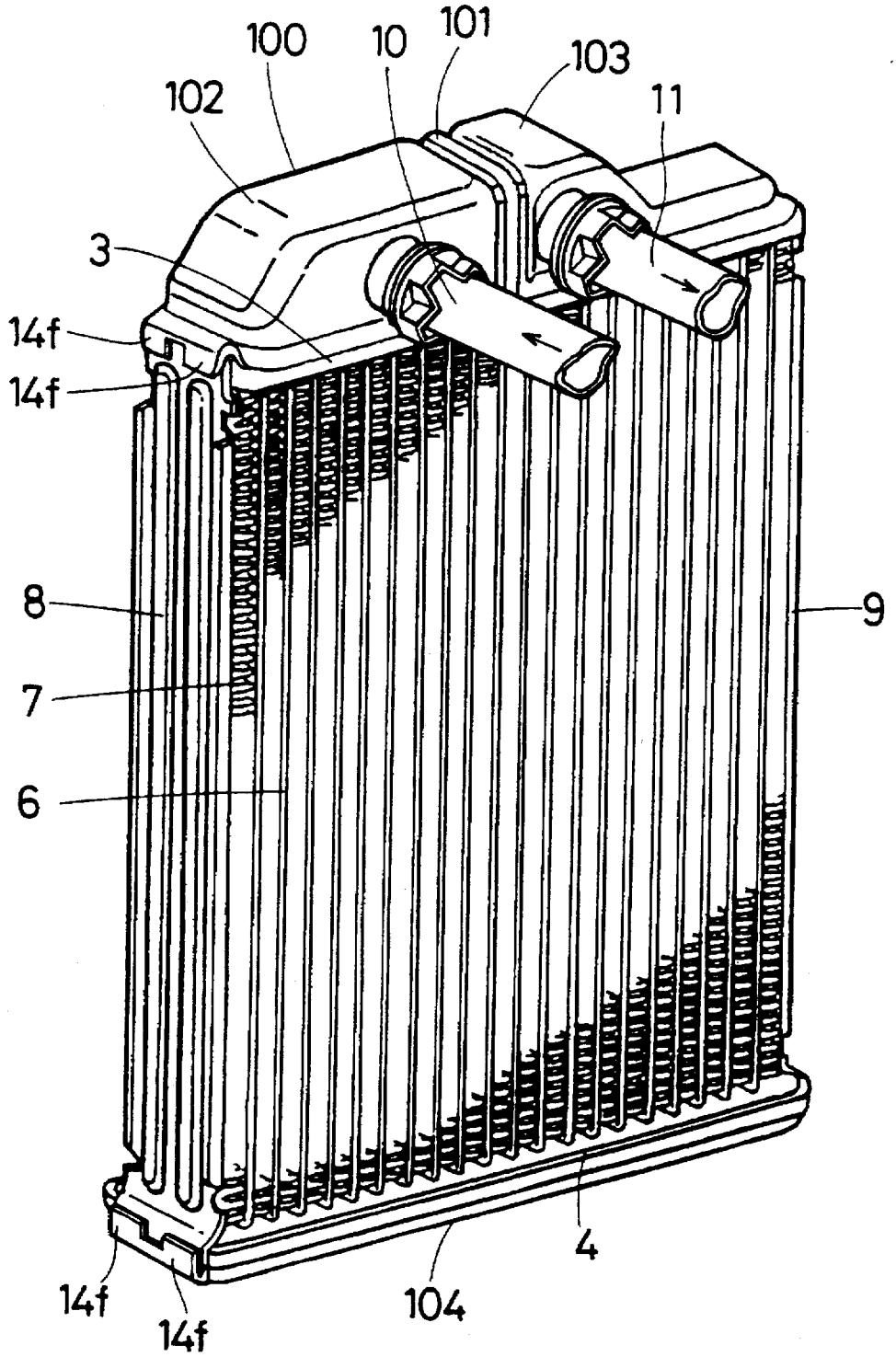
FIG. 7 is a perspective view illustrating a heat exchanger according to a third embodiment of the present invention.

In FIG. 7, a partition member 101 is disposed at a central position in a width direction of a tank 100 (an upper tank in FIG. 7) and an inside of the tank 100 is divided into two chambers 102 and 103 by the partition 101. An inlet pipe 10 is provided on the chamber 102 and an outlet pipe 11 is provided on the chamber 103.

Thus, warm water flowing from the inlet pipe 10 to the outlet pipe 11 of the tank 100 flows into the other lower tank 104 through a tube 6 at a left half side. In the tank 104, the warm water makes a U-turn and flows in the chamber 103 of the tank 100 through the tube 6 at a right half side and flows out toward the outside from the outlet pipe 11.

In the U-turn flow type heat exchanger shown in FIG. 7, since the partition member 101 is necessary to divide the tank 100 into two chambers 102 and 103, a position of the partition member 101 needs to be considered when the tank 100 is formed.

A method for disposing the partition member 101 on the tank 100 is explained below.

Figure 8A:
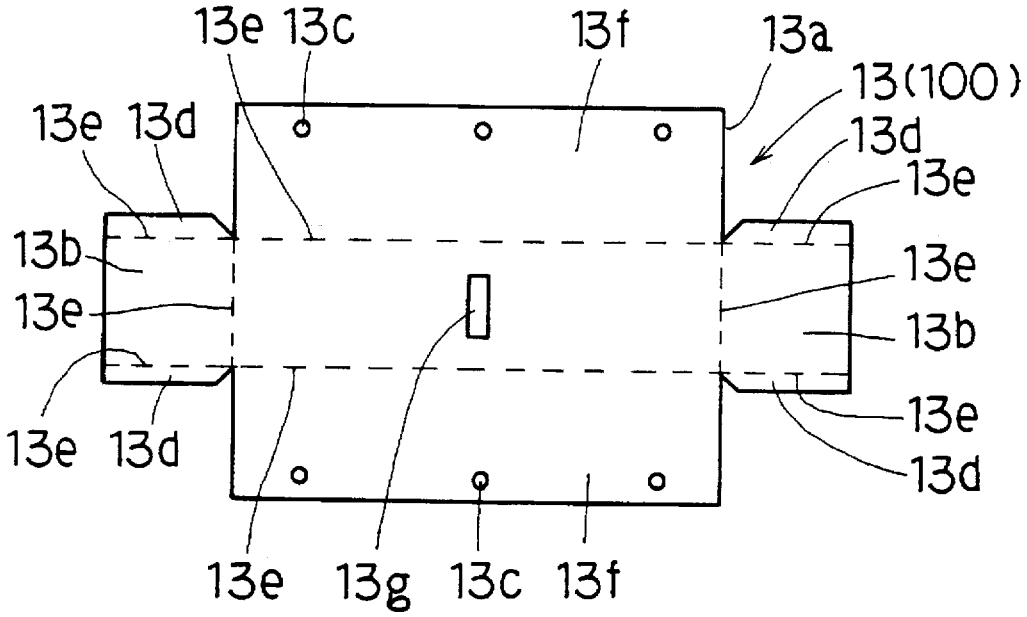
FIG. 8A is a plan view illustrating a metal plate forming a tank according to the third embodiment of the present invention.
Figure 8B:
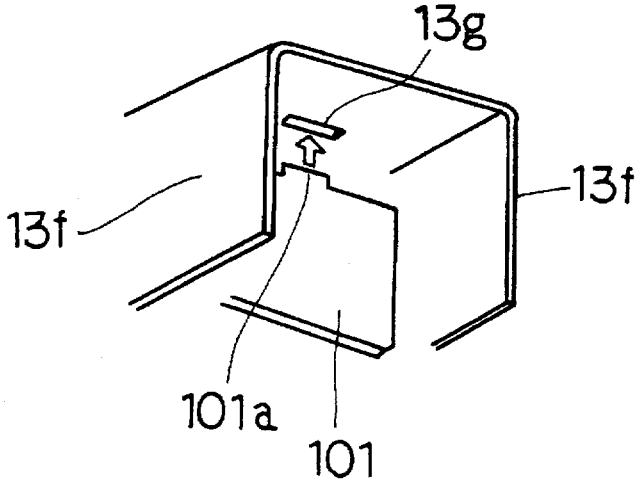
FIG. 8B is an exploded view illustrating a main portion of an assembly of the tank and a partition member according to the third embodiment.

FIG. 8A illustrates the unfolded metal plate 13 for a tank corresponding to FIG. 2. A hole 13*g* is provided at a central portion of the body portion 13*a* and a protrusion 101*a* of the partition member 101 which is separated from the tank 100 and made of metal such as aluminum or the like is fitted into the hole 13*g* (refer to FIG. 8B). Therefore, while being prevented from falling, the partition member 101 is joined between the tank 100 and the base plate 3 by brazing.

Figure 9A:
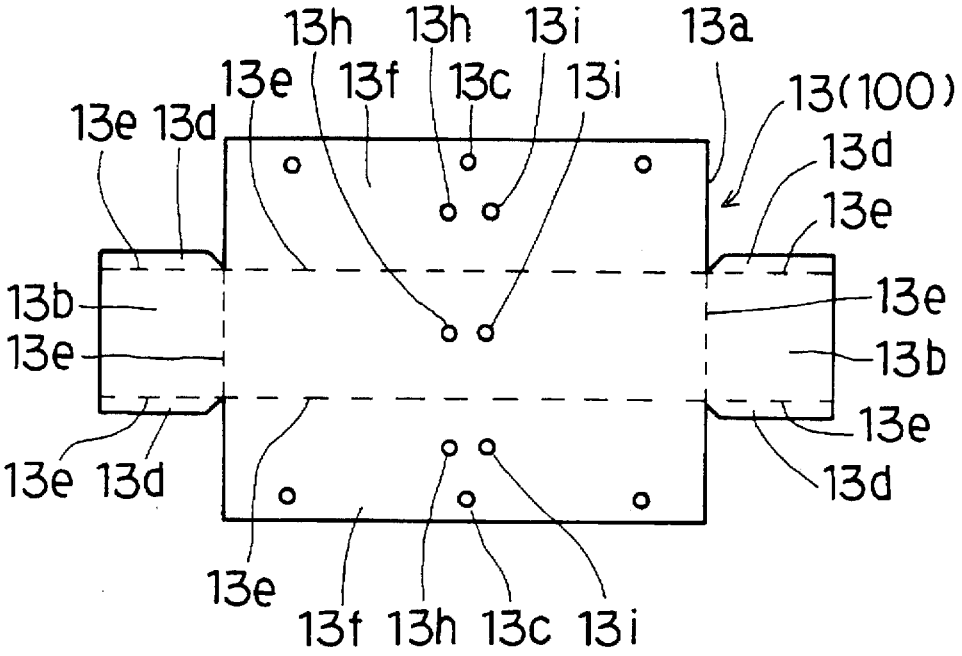
FIG. 9A is a plan view illustrating a modification of a metal plate forming the tank according to the third embodiment of the present invention.
Figure 9B:
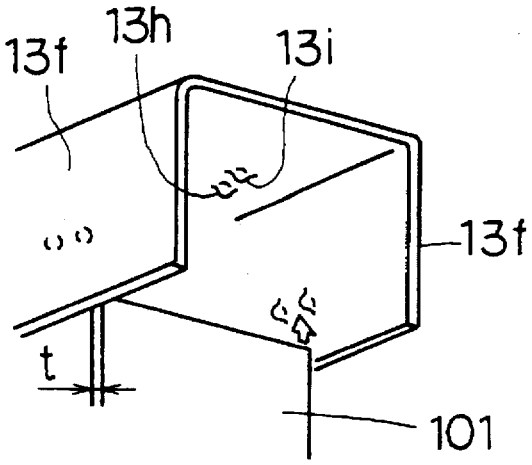
FIG. 9B is an exploded perspective view illustrating a main portion of the assembly of the tank and the partition member in that variation.

FIGS. 9A and 9B illustrate a modification of this embodiment. A pair of protrusions 13*h* and 13*i* formed at a slightly larger interval than a plate thickness "t" of the partition member 101 is provided at a plurality of places at a central portion of the body portion 13*a* of the unfolded metal plate 13 for the tank. By holding the end portions of the partition member 101, the partition member 101 is joined between the tank 100 and the base plate 3 by brazing while being prevented from falling.

Figure 10A:
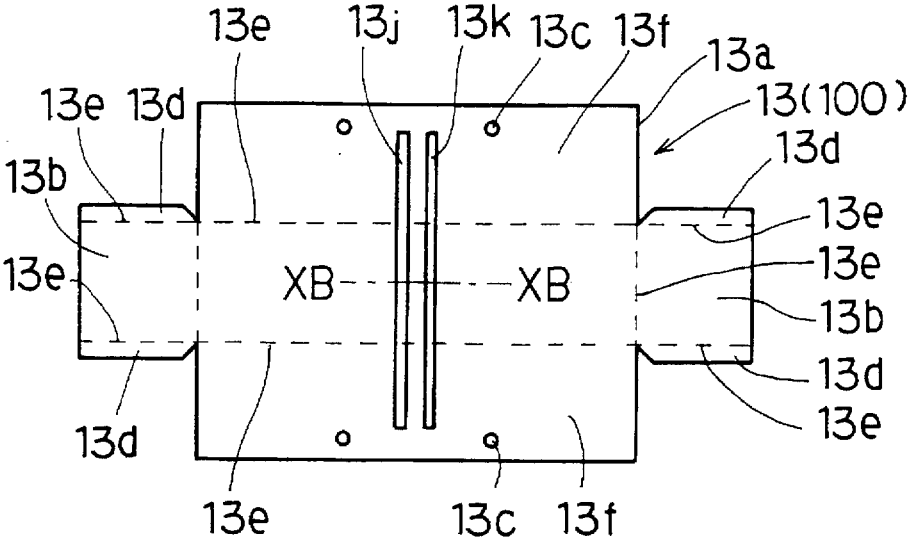
FIG. 10A is a plan view illustrating another modification of the metal plate forming the tank according to the third embodiment of the present invention.
Figure 10B:
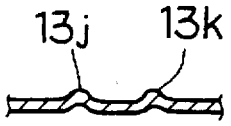
FIG. 10B is a cross-sectional view taken along line XB—XB of FIG. 10A.
Figure 10C:
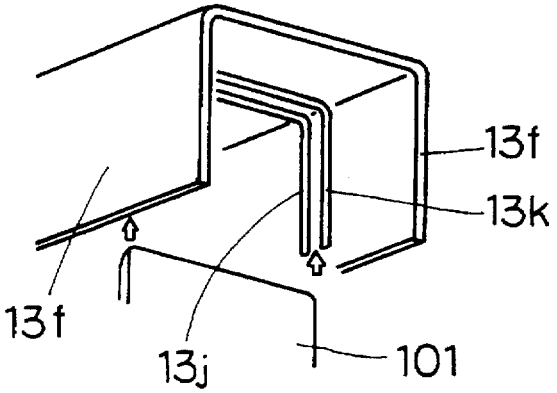
FIG. 10C is an exploded perspective view illustrating a main portion of the assembly of the tank and the partition member in this variation.

FIGS. 10A through 10C illustrate another modification of this embodiment. A pair of protrusions 13*j* and 13*k* extending with a belt-like shape are formed at a slightly larger interval than the plate thickness "t" of the partition member 101. By holding the end portions of the partition member 101 between the protrusions 13*j* and 13*k*, the partition member 101 is joined between the tank 100 and the base plate 3 by brazing while being prevented from falling.

Figure 11:
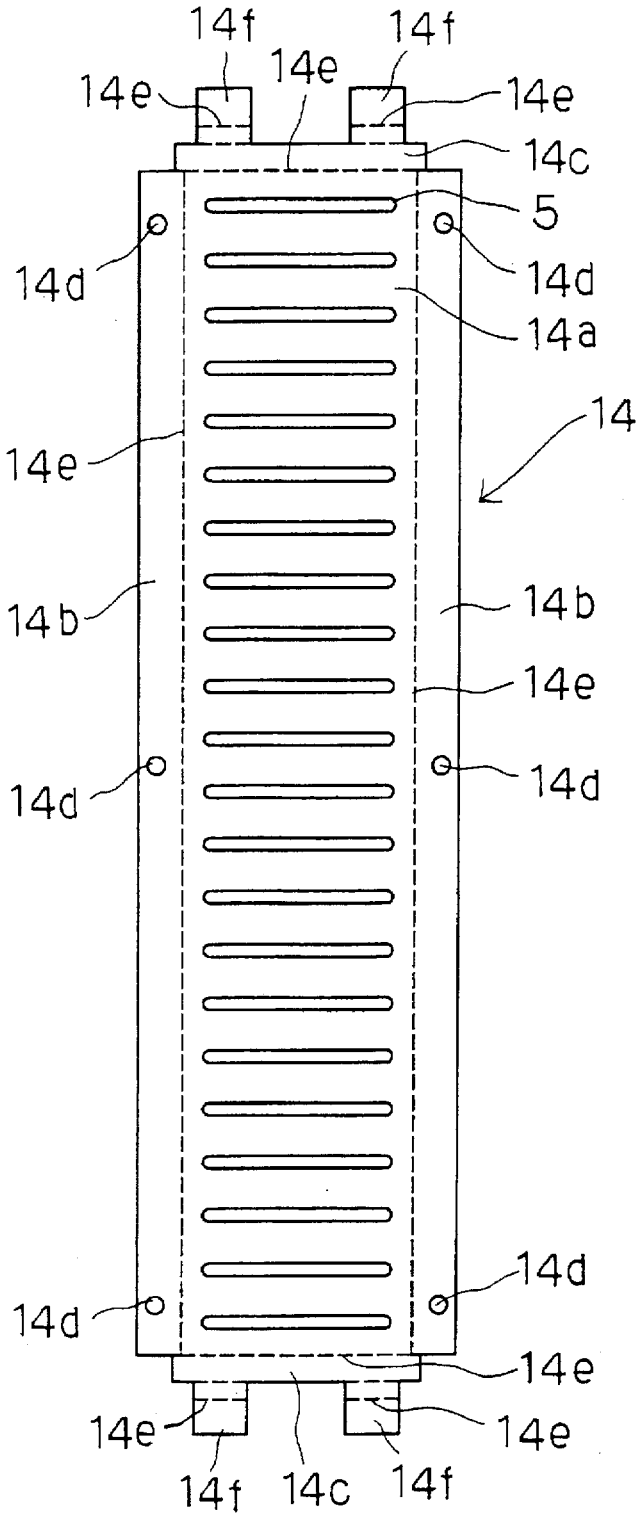
FIG. 11 is a plan view illustrating the metal plate forming a base plate according to the third embodiment of the present invention.

FIG. 11 illustrates the unfolded metal plate 14 for the base plate corresponding to FIG. 4. A pair of claw pieces 14*f* extending outwardly are provided at two places at the second folded portion 14*c* of the metal plate 14. As shown in FIG. 7, by folding the claw pieces 14*f* on outer surfaces of both end portions of the base plates 3 and 4, an assembly position of the end plates 8 and 9 is held.

Figure 12:
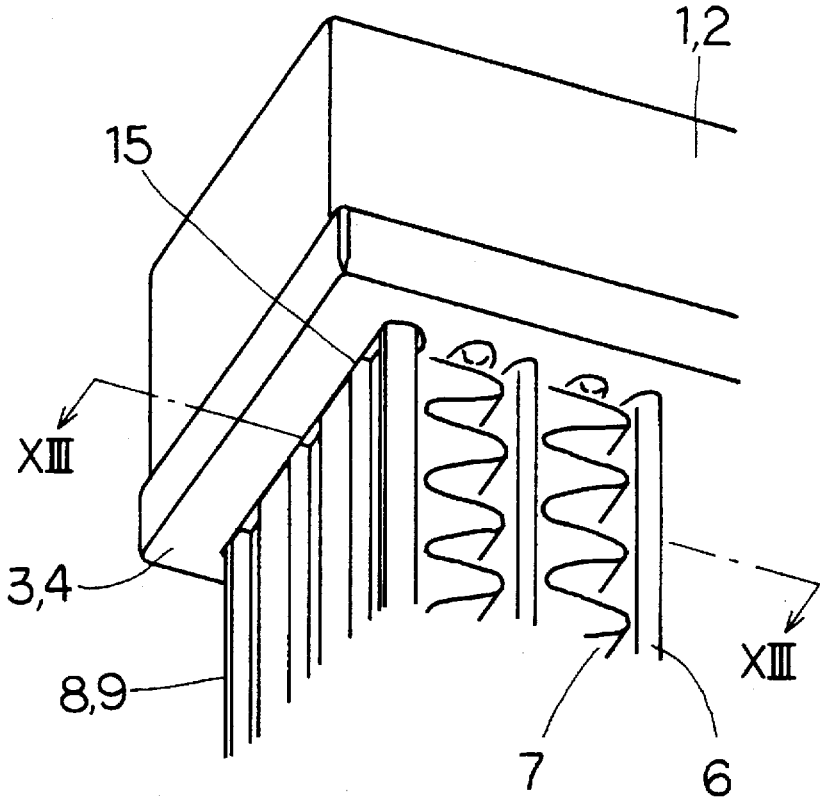
FIG. 12 is a perspective view illustrating a main portion of a heat exchanger according to a fourth embodiment of the present invention.
Figure 13:
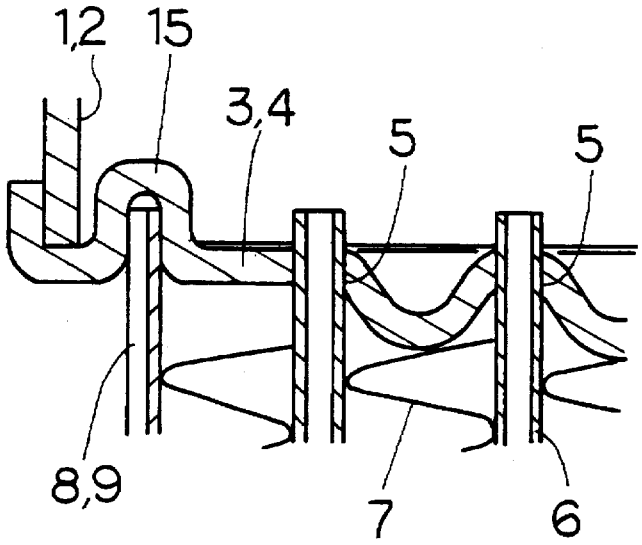
FIG. 13 is a cross-sectional view taken along line XIII—XIII of FIG. 12.

Another embodiment according to the present invention will be described below. As shown in FIGS. 12 and 13, in order to hold the assembly position of the end plates 8 and 9, a concave portion 15 (refer to FIG. 13) which is slightly larger than a cross-sectional shape of the end plates 8 and 9 is provided at an outer side from the tube inserting hole 5 at a bottom wall surface of the base plates 3 and 4. The concave portion 15 is formed across generally a full length in the width direction of the bottom wall surface of the base plates 3 and 4, and the width of the concave portion 15 is slightly larger than that of the end plates 8 and 9.

End portions of the end plates 8 and 9 are inserted into the concave portion 15 to hold the assembly position of the end plates 8 and 9.

At a manufacturing process of an aluminum heat exchanger, when the heat exchanging portions 6 and 7 are laminated at a manufacturing process of an aluminum heat exchanger, a reaction force which urges the heat exchanging portion to spread out in a lamination direction (width direction) is produced. Since the reaction force is received by the end plates 8 and 9, the end plates 8 and 9 need to be made of a steel plate having greater strength than aluminum.

In this case, stress converges at a joint portion between the end plates 8 and 9 of steel plates and the aluminum base plates 3 and 4, and then the aluminum base plates 3 and 4 are deformed. As a result, a brazing performance of the base plates 3 and 4 and the tanks 1 and 2 is interrupted, and therefore, brazing malfunction may occur.

In order to prevent the brazing malfunction, in this embodiment, the holding mechanism of the end plate assembly position is applied as described above. The end portions of the end plates 8 and 9 are inserted into the concave portion 15 formed across generally the full length in the width direction of the bottom wall surface of the base plates 3 and 4 and the assembly position of the end plates 8 and 9 are held. Therefore, even though an assembling reaction force of the heat exchanging portion is applied to the aluminum base plates 3 and 4 from the end plates 8 and 9 of the steel plates, the reaction force can be received at the bottom wall surface as a whole of the base plates 3 and 4. Since stress concentration is not caused partially, the brazing malfunction due to deformation of the aluminum base plates 3 and 4 can be prevented.

Another embodiment of the present invention will be described below. In the embodiment shown in FIGS. 14A and 14B, in the aluminum heat exchanger, a difference of melting points between the aluminum base metal constructing the tank 1 and 2 and a brazing material (Al—Si series alloy) cladded on the base material is small. Therefore, when the aluminum base material is heated up to the melting point of the brazing material at brazing, the aluminum base material weakens. Thus, depending on the position of the heat exchanger at brazing, the second folded portion 13*b* of the unfolded metal plate 13 for the tank may be deformed by its weight and a folding angle of the second folded portion 13*b* cannot be maintained at 90°.

For example, the second folded portion 13*b* may fall inwardly toward or fall outwardly from a tank box-shape. As a result, the second folded portion 13*b* and the first folded portion 13*f* cannot be brazed appropriately.

Figure 14A:
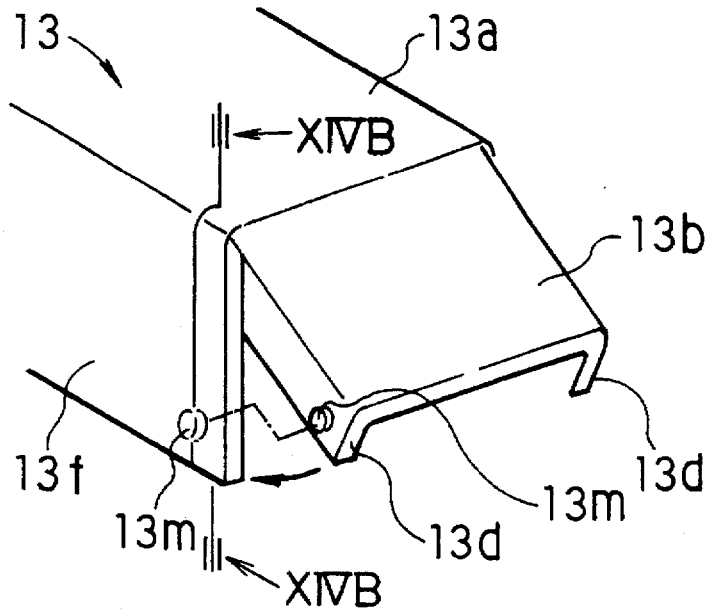
FIG. 14A is a perspective view illustrating a main portion of an assembling of a metal plate for the tank according to a fifth embodiment of the present invention.
Figure 14B:
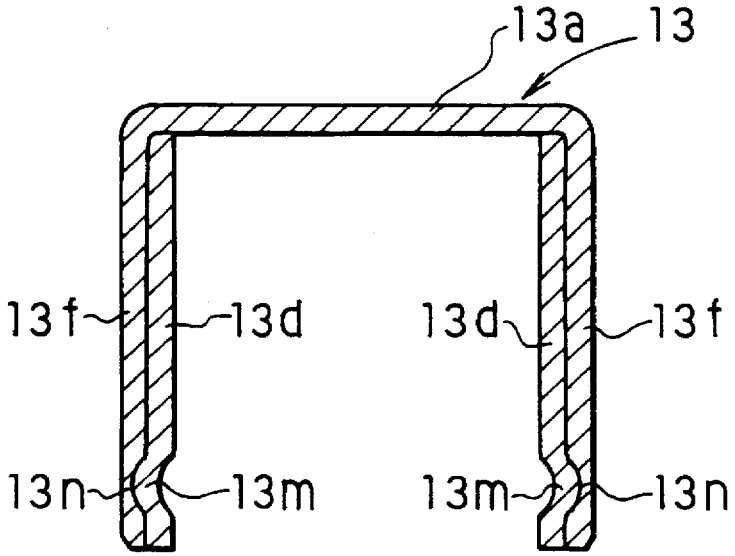
FIG. 14B is a cross-sectional view taken along line XIVB—XIVB of FIG. 14A.

In the embodiment shown in FIGS. 14A and 14B, on a portion where the joint portion 13*d* of the second folded portion 13*b* is in contact with the first folded portion 13*f*, a semicircular protrusion 13*m* is formed at either the joint portion 13*d* or the first folded portion 13*f* (at the joint portion 13*d* in the embodiment shown in FIGS. 14A and 14B) and a semicircular concave portion 13*n* into which the protrusion 13*m* is fitted is formed at the other of the joint potion 13*d* and the first folded portion 13*f* (at the joint portion 13*f* in FIGS. 14A and 14B). By fitting the protrusion 13*m* into the concave portion 13*n* as shown in FIG. 14B, the folding angle of the second folded portion 13*b* can be maintained at 90°.

As a result, whenever the heat exchanger is positioned during brazing, the folding position of the second folded portion 13*b* is maintained properly and the second folded portion 13*b* and the first folded portion 13*f* can be brazed appropriately.

By providing a fitting mechanism where the protrusion 13*m* is fitted into the concave portion 13*n*, in a temporary assembling process before brazing, the folded portion of the first and the second folded portions 13*b* and 13*f* can be prevented from returning due to elasticity of aluminum (spring back).

Another embodiment of the present invention will be described below. In the embodiment shown in FIGS. 15 and 16, an inserting hole 13*p* of the inlet and the outlet pipes 10 and 11 is open at the second folded portion 13*b* of the unfolded metal plate 13 for the tank, and the inlet and the outlet pipes 10 and 11 are inserted into the inserting hole 13*p*. At brazing, a bending moment is applied to the second folded portion 13*b* by the weights of the inlet and the outlet pipes 10 and 11. The second folded portion 13*b* is heated at high temperature by brazing and is influenced by the bending moment, and therefore, the second folded portion 13*b* may fall into the interior of the box-shape.

Figure 15:
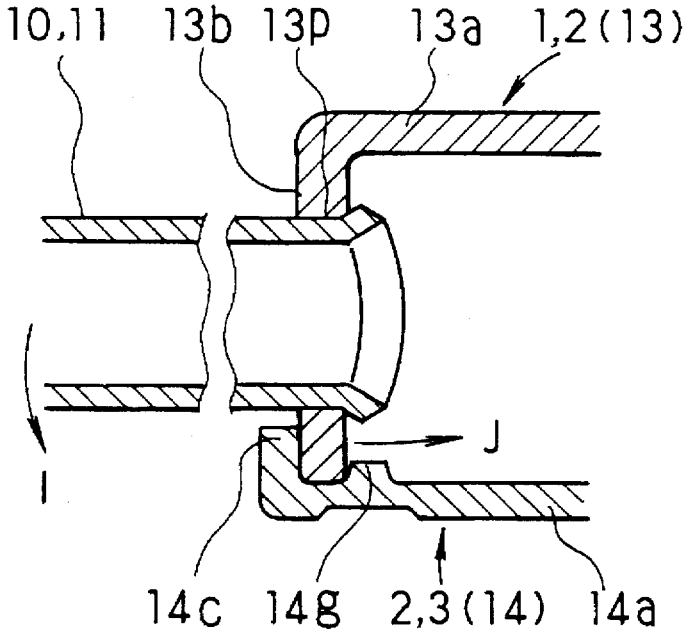
FIG. 15 is a cross-sectional view illustrating a main portion of the tank portion according to a sixth embodiment of the present invention.
Figure 16:
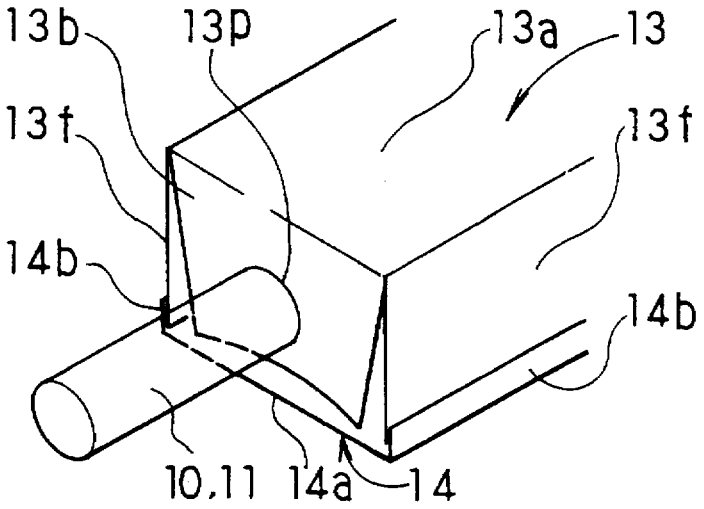
FIG. 16 is a perspective view illustrating a main portion of the tank portion according to the sixth embodiment of the present invention.
Figure 17:
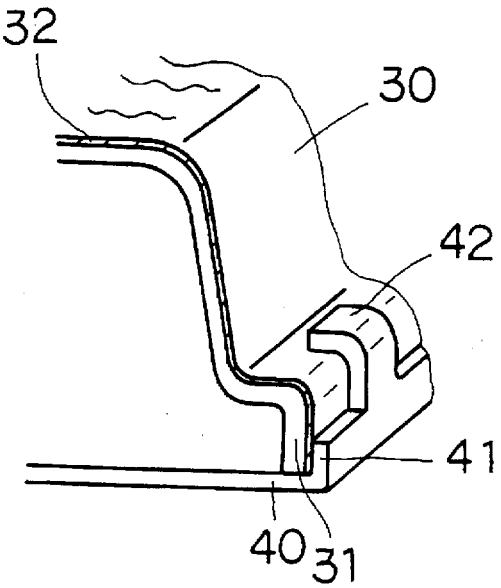
FIG. 17 PRIOR ART
FIG. 17 is a perspective view illustrating a main portion of an assembling structure of a tank and a base plate portion of a conventional heat exchanger.
Figure 18:
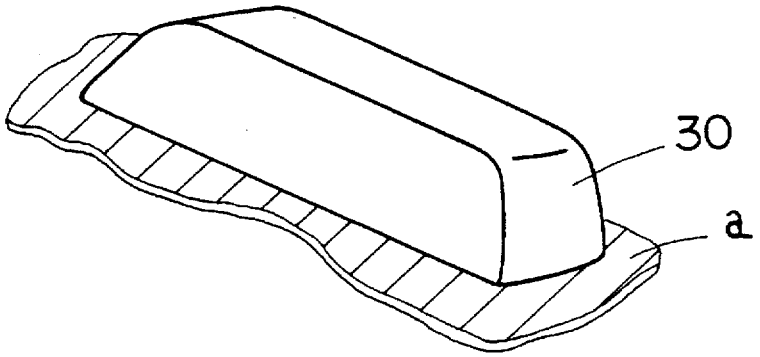
FIG. 18 PRIOR ART
FIG. 18 is a perspective view illustrating a method for forming the tank of the conventional heat exchanger.
Figure 19:
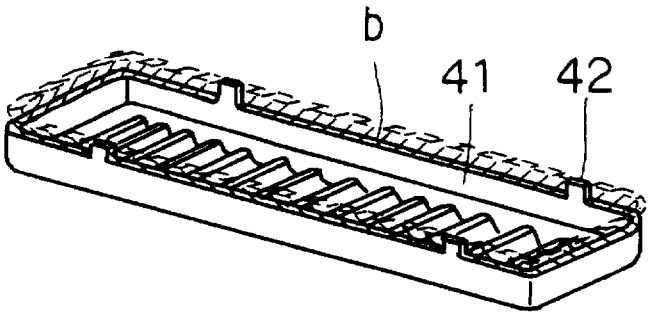
FIG. 19 PRIOR ART
FIG. 19 is a perspective view illustrating a method for forming a base plate of the conventional heat exchanger.

As shown in FIG. 15, a protrusion 14*g* protruding toward the second folded portion 13*b* of the unfolded metal plate 13 for the tank is formed at a portion adjacent to the second folded portion 14*c* of the unfolded metal plate 14 for the base plates. A concave portion into which a tip end of the second folded portion 13*b* of the unfolded metal plate 13 for the tank is fitted is formed between the protrusion 14*g* and the second folded portion 14*c*.

According to the above-described structure, even though the bending moment in an arrow I direction with respect to the second folded portion 13b is applied by the weights of the inlet and the outlet pipes 10 and 11 at brazing, movement in an arrow J direction of the second folded portion 13b can be surely prevented by the protrusion 14g. Therefore, the second folded portion 13b of the unfolded metal plate 13 for the tank and the second folded portions 14c of the unfolded metal plate 14 for the base plates are brazed securely.

Another embodiment of the present invention will be described below. In the first and the second embodiments, on the joint surface of the tanks 1 and 2 and the base plates 3 and 4, the semicircular protrusion 13c is provided at the tanks 1 and 2 and a semicircular concave portion 14d is provided at the base plates 3 and 4, and the protrusion 13c is fitted into the concave portion 14c. However, a semicircular protrusion is provided at the base plates 3 and 4 and a semicircular concave portion may be provided at the tanks 1 and 2. That is to say, at the joint portion of the tanks 1 and 2 and the base plates 3 and 4, a protrusion is provided at one side and a concave portion into which the protrusion is fitted is provided at the other side.

As shown in FIG. 3, although the second folded portion 14c is folded on the end surface of the first folded portion 14b in the unfolded plate 14 for the base plates, the first folded portion 14b can be folded on the end surface of the second folded portion 14c in such a manner to contact with the end surface of the second folded portion 14c. In this case, the end portion in the longitudinal direction of the second folded portion 14c needs to be shifted by an offset of the plate thickness d2 of the unfolded metal plate 14 inwardly from the folding position 14e of the first folded portion 14b.

The present invention is not limited to a heater core for a heater and can be used widely in a heat exchanger for an automotive radiator or the like.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A heat exchanger comprising:

a tank formed in a box shape, said tank including folded portions to form an opening;

a base plate formed in a box shape and covering said opening of said tank, said base plate including folded portions fixed to said folded portions of said tank and a bottom portion including a hole therein; and a tube inserted into said hole of said base plate and fixed to said base plate to keep fluid communication with said tank, wherein each of said tank and said base plate is made from an unfolded metal plate by folding, and wherein said unfolded metal plate includes:

a body portion formed in a rectangular shape having a pair of long sides and a pair of short sides;

a pair of first folded portions formed along said long sides of said body portions; and a pair of second folded portions formed along said short sides of said body portion, wherein said first and second folded portions are folded and joined to form a box shape.

2. A heat exchanger according to claim 1, wherein said folded portion of said unfolded metal plate has a joint surface for enlarging a joint area between said tank and said base plate.

3. A heat exchanger according to claim 2, wherein said joint surface is provided at said second folded portion of said unfolded metal plate for said tank.

4. The heat exchanger according to claim 3, wherein said joint surface is made in contact with said first folded portion of said unfolded metal plate for said tank, and at a contacting portion between said joint surface and said first folded portion, a protrusion is provided at one side and a concave portion into which said protrusion is fitted is provided at the other side.

5. A heat exchanger according to claim 4, wherein at a joint surface between said tank and said base plate, a protrusion is provided at one side of said joint surface, and a concave portion into which said protrusion is fitted is provided at the other side of said joint surface.

6. A heat exchanger according to claim 5, wherein:

said second folded portion of said unfolded metal plate for said tank connects with inlet and outlet pipes for fluid, and said unfolded metal plate for said base plate has a protrusion adjacent to said second folded portion, wherein a tip portion is held between said second folded portion of said unfolded metal plate for said base plate and said protrusion.

7. A heat exchanger according to claim 6, wherein said unfolded metal plate for said base plate has a folding position at said first folded portion, and end portions of said second folded portion in a longitudinal direction are shifted by an offset of a plate thickness with respect to said folding position of said first folded portion.

8. A heat exchanger according to claim 3, wherein said unfolded metal plate for said tank has first and second folding positions of said joint surfaces of said first and second folded portions, respectively, and said second folding position is shifted by an offset of a plate thickness with respect to said first folding position of said first folded portion.

9. A method for manufacturing a heat exchanger including a box-shaped tank, a box-shaped base plate and a tube, said method comprising:

cutting a metal plate to make an unfolded metal plate for forming said box-shaped tank;

cutting a metal plate to make an unfolded metal plate for forming said base plate and making a hole into which said tube is inserted at said base plate, said unfolded metal plate for forming said box-shaped tank and said base plate being formed by:

forming a body portion in a rectangular shape having a pair of long sides and a pair of short sides;

forming a pair of first folded portions along said long sides of said body portion; and forming a pair of second folded portions along said short sides of said body portion;

folding and joining said first and second folded portions of said metal plate for said tank along a predetermined folding line to form said tank in a box shape having an opening;

folding and joining said first and second folded portions of said metal plate for said base plate along a predetermined folding line to form said base plate in a box shape having an opening;

inserting an end portion of said tube into said hole of said base plate and assembling said tank with said base plate to cover said opening of said tank; and brazing said tank and said base plate and said tube integrally to make an assembled body.

* * * * *